US008066120B2

(12) United States Patent
Jarvis et al.

(10) Patent No.: US 8,066,120 B2
(45) Date of Patent: Nov. 29, 2011

(54) SACHET CONSTRUCTIONS

(75) Inventors: Mark Andrew Jarvis, Maidenhead (GB); James Robert Langmeier, Hamilton, OH (US); James Peter Brastauskas, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 218 days.

(21) Appl. No.: 12/634,769

(22) Filed: Dec. 10, 2009

(65) Prior Publication Data

US 2010/0224522 A1 Sep. 9, 2010

Related U.S. Application Data

(62) Division of application No. 10/360,291, filed on Feb. 7, 2003, now Pat. No. 7,757,855.

(60) Provisional application No. 60/354,997, filed on Feb. 8, 2002.

(51) Int. Cl.
*B65D 85/84* (2006.01)
*A61K 9/00* (2006.01)

(52) U.S. Cl. ..... 206/524.1; 424/400

(58) Field of Classification Search ..... None
See application file for complete search history.

(56) References Cited

U.S. PATENT DOCUMENTS

| | | | | |
|---|---|---|---|---|
| 4,124,965 | A | 11/1978 | Stahl | |
| 4,290,526 | A | 9/1981 | Haiss | |
| 5,222,813 | A | 6/1993 | Kopp et al. | |
| 5,371,997 | A | 12/1994 | Kopp et al. | |
| 5,472,093 | A | 12/1995 | Nugent et al. | |
| 5,511,665 | A | 4/1996 | Dressel et al. | |
| 5,938,032 | A | 8/1999 | Svec et al. | |
| 6,260,735 | B1 * | 7/2001 | Fuquen | 222/94 |
| 6,352,364 | B1 | 3/2002 | Mobs | |

FOREIGN PATENT DOCUMENTS

| | | |
|---|---|---|
| FR | 1 280 211 | 12/1961 |
| FR | 1 399 493 | 4/1965 |
| WO | WO95/01921 | 1/1995 |
| WO | WO96/29256 | 9/1996 |
| WO | WO03/010067 | 2/2003 |

* cited by examiner

*Primary Examiner* — Robert A Wax
*Assistant Examiner* — Jessica N Worsham
(74) *Attorney, Agent, or Firm* — Alexandra S. Anoff; Amanda T. Barry

(57) ABSTRACT

The present invention relates to an improved child resistant sachet construction, suitable for holding a medicinal product, especially a flavored product. The sachet is a three seal sachet, or stick pack, made from a laminate sheet, the sachet having a fin seal along a longitudinal axis and transverse fin seals at each end. The laminate sheet is tough enough to resist tearing unless a notch is provided with which to initiate a tear. A fold line extends across a corner of the sachet and through the fin seal, a notch extending through the sachet in a transverse seal area and perpendicular to the fold line such that when the sachet is folded a cut is revealed that allows the user to initiate a tear across the pack opening up a pouring spout for dispensing the medicinal product. In an alternative aspect of the invention the laminate sheet is provided with an acrylonitrile methyl acrylate copolymer resin on the sheet face which forms the inside of the sachet. This layer provides improved retention of flavor while still allowing the sachet to be readily torn once a tear has been initiated.

9 Claims, 1 Drawing Sheet

SACHET CONSTRUCTIONS

CROSS REFERENCE TO RELATED APPLICATIONS

This application is a divisional application of U.S. application Ser. No. 10/360,291, filed on Feb. 7, 2003 now U.S. Pat. No. 7,757,855 which claims the benefit of U.S. Provisional Application No. 60/354,997, filed Feb. 8, 2002.

FIELD OF THE INVENTION

The present invention relates to child resistant sachets for medicinal products, of the type wherein the sachet is ordinarily resistant to tearing but a notch is provided which, when the sachet if folded across the notch, reveals a cut edge for initiating a tear, thus allowing the sachet contents to be dispensed.

BACKGROUND OF THE INVENTION

Medicinal products can be harmful if taken in excess amount or by someone other than the intended recipient, especially small children. Accordingly it is customary to provide packages for certain products which cannot readily be opened by children but which nevertheless contain features allowing an adult to open the package once it is manipulated in a special way. This invention relates to a three seal sachet, commonly also known as a stick pack, which has a longitudinal seal and two transverse seals. Such three seal sachets are frequently used for food items but do not typically come with child resistant features. A tear notch may be provided in such sachets but it is usually located in an obvious position at the edge of the sachet such that the method of opening is either obvious or the package can be opened inadvertently.

PCT application WO 95/01921 describes a stick pack for liquid drugs, but it too provides a notch on the edge of the pack which provides insufficient challenge to opening by a young child.

U.S. Pat. Nos. 5,222,813 and 5,371,997 describe packaging bags with a longitudinal fin seal and tear-open slits which extend through the fin seal but, like WO 95/01921, only disclose a notch starting on the edge of the pack and therefore with insufficient child resistance.

U.S. Pat. Nos. 5,511,665 and 5,472,093 concern packages suitable for pharmaceuticals incorporating 'hidden notches' which only reveal a tear slit after a particular fold is made, thus making the method of opening much more difficult for a small child to discern but nevertheless allowing opening by an adult able to follow instructions.

It is an object of the present invention to improve the child resistance of stick or three seal packs or sachets which have advantages in the dispensing of liquids and powders. It is a further object of the present invention to provide three seal packs or sachets which have improved resistance to flavour loss and thus to make them more suitable for medicinal products where it is important to have a flavour to mask the bitter taste of many medicinal active agents.

These and other objectives will become readily apparent from the detailed description that follows.

SUMMARY OF THE INVENTION

In a first aspect, the present invention provides a three seal sachet for a medicinal product comprising:

a) a laminate sheet comprising opposed first and second longitudinal sheet edges and opposed first and second sheet faces; wherein
   i) the laminate sheet is folded to form first and second opposed longitudinal sachet edges and opposed first and second sachet faces; and
   ii) the laminate sheet is sealed to itself along marginal portions of the first and second longitudinal sheet edges on the first sheet face, thereby forming a flattened tube with a fin seal on the first sachet face, the fin seal being folded against the first sachet face;

b) first and second transverse seals bonding together the laminate sheet along marginal portions of first and second transverse edges of the sheet on the first sheet face, thereby closing the tube at each end;

c) a fold line (BB') extending from the first transverse edge of the sheet, through the first transverse seal and the fin seal, to the first sachet longitudinal edge; and d) a notch passing through the first transverse seal and the fin seal and intersecting the fold line, such that when the sachet is folded along the fold line a cut edge is revealed for tearing open the sachet.

This sachet design disclosed herein provides improved child resistance in a package form which has advantages in dispensing of the product since, with a fin seal along one face of a pack it has been found that the package holds a better three dimensional shape and provides easier pouring than a flat sachet with seals along all four sides.

The length and location of the fold line, and the location of the notch are important in ensuring that the package can be opened without difficulty when manipulated in the intended manner and that a sufficiently large pouring spout is obtained through which the product can be completely dispensed.

In a second but related aspect the invention further relates to sachets of similar form wherein the inside layer of the sachet laminate is an acrylonitrile methyl acrylate copolymer resin which provides improved flavour barrier properties without compromising on the tear characteristics of the sachet. In this second aspect, which is especially useful when the sachet is intended for medicinal products comprising bitter tasting active agents, such as dextromethorphan, and when flavouring and flavour retention is essential in order to make the medicinal product palatable, it is less important where the longitudinal fin seal is located and it can be on a longitudinal edge of the sachet.

Preferably both aspects of the invention are combined in order to maximise user acceptance of the package and provide improved patient compliance.

DESCRIPTION OF PREFERRED EMBODIMENTS

The present invention is now described in detail by way of an embodiment thereof with reference to the accompanying drawings.

Figure 1:
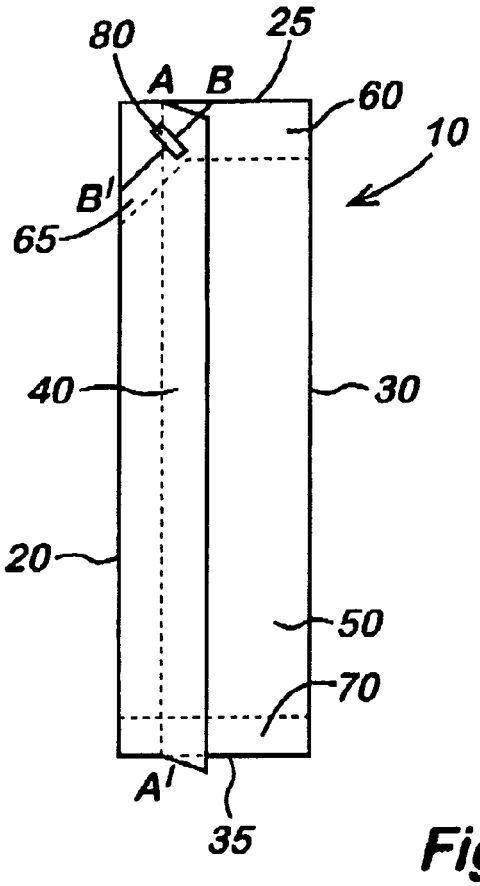
FIG. 1. is a plan view of a three seal sachet according to the invention. The dotted lines indicate the extent of the seals from the sachet edges.
Figure 2:
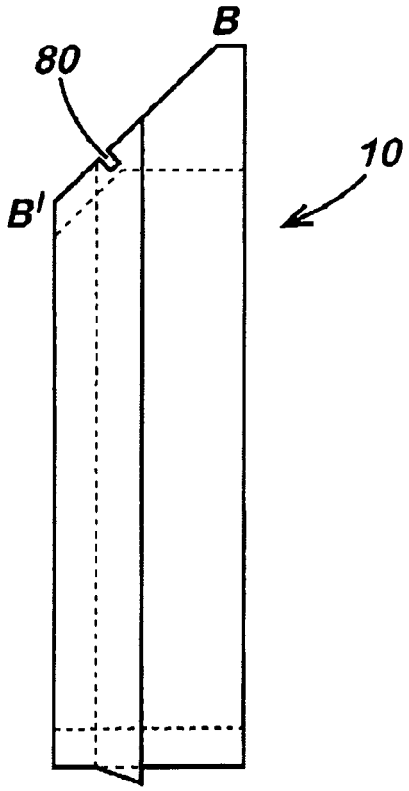
FIG. 2. is a further plan view of the embodiment shown in FIG. 1 with the package shown folded along its fold line to reveal the notch.
Figure 3:
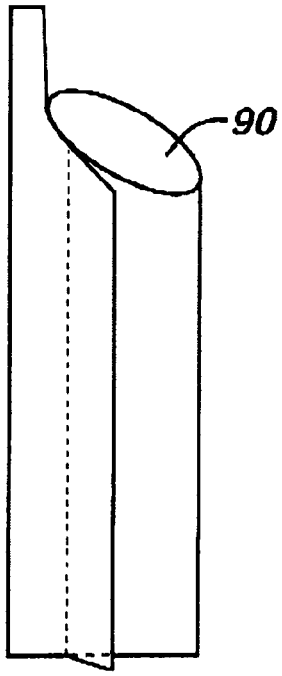
FIG. 3. is a perspective view of the same embodiment after opening showing the formation of a pouring spout.

The three seal sachet 10, illustrated in FIGS. 1, 2 and 3, essentially comprises a longitudinally folded packaging wrapper having a longitudinal seal 40 to turn it into a tube and transverse seals 60 and 70 at first 25 and second 35 transverse edges of the sheet to close the tube and form a hermetically sealed inner volume capable of containing and protecting a medicinal product until the sachet is opened. In the first aspect of the invention the longitudinal seal is a fin seal 40, that is, the longitudinal edges of the sachet are merely folds and the longitudinal seal is located on the first face 50 of the sachet. In the second aspect of the invention the longitudinal seal may be a fin seal as described above, but it is alternately possible for the longitudinal seal to be along one longitudinal edge of the sachet, the longitudinal edge of the sachet being a fold.

At the seals the first face of the laminate sheet is bonded to itself along marginal portions of the sachet edges. Heat sealing is preferred. The bonded marginal portions generally have a width of from about 3 mm to 5 mm for the longitudinal seal and from about 3 mm to about 12 mm for the transverse seals. In a preferred aspect, the first transverse seal has an enlarged area 65 extending longitudinally along the first longitudinal sachet edge. This is to assist in the formation of a fold line BB' which does not compromise the pack integrity. This enlarged area may extend up to 20 mm or more along the first longitudinal sachet edge 20. In the embodiment shown the fold line BB' extends into said enlarged area 65.

Preferred dimensions of the sachet are to have a length of from about 5 cm to about 15 cm, more preferably from about 6 cm to about 10 cm, along its longitudinal edges and to have a width of from about 10 mm to about 25 mm, more preferably from about 12 mm to about 18 mm, along its transverse seals. The sachet will generally contain from about 0.5 to about 5 ml of product, more preferably from about 0.5 ml to about 2 ml. If the sachet is much wider than about 25 mm then it becomes more difficult to squeeze the entire does out of the package, leading to undesirable underdosing of the medicinal product.

A fin seal herein will generally be folded against the sachet face on which it is formed, the direction of folding is not especially important, though in preferred embodiments it is folded such that the laminate sheet edges are directed away from the first longitudinal sachet edge.

The sachet comprises a fold line BB' extending from the first transverse edge 25 of the sheet, through the first transverse seal 60 and the fin seal 40, in at least the first aspect of the invention, to the first sachet longitudinal edge 20. The fold line may be no more than a printed indication on the pack to inform the user where to make a fold. In preferred embodiments the sachet comprises mechanical means to assist folding along the fold line. Such mechanical means may comprise a crease or an unsealed area extending along the fold line. Clearly the unsealed area should not be of such excessive width that the sachet integrity is compromised. The mechanical means may alternately be a change in the knurling pattern applied by the clamping jaws typically used to effect a seal.

The sachet further comprises notch 80 passing through the first transverse seal 60 and, at least in the first aspect of the invention, also through the fin seal 40 and intersecting the fold line BB', such that when the sachet is folded along the fold line a cut edge is revealed for tearing open the sachet. If the sachet has a fin seal and the notch does not pass through it then the fin seal may interfere with the propagation of the tear required to open the sachet. The notch 80 is located entirely within the sealed area so as to ensure that the hermetic seal of the package is not endangered. Preferably a spacing between said notch 80 and said inner volume of the sachet is at least about 2 mm, more preferably at least about 3 mm. The notch aids in initiating the tearing of sachet, once folded to create a pouring spout 90.

Notch 80 intersects fold line BB'. The angle of intersection can be any angle provide there is sufficient notch either side of the line to initiate a tear once the sachet is folded. The notch preferably extends perpendicularly to the fold line.

The fold line BB' preferably has a length of at least about 8 mm, more preferably at least about 10 mm and yet more preferably at least about 12 mm. This is to enable the insertion of notch 80 intersecting the fold line and sufficient space to each side of the notch for a user to grip the folded sachet. Suitably said notch is at a distance of at least 4 mm, preferably at least 5 mm from each end of the fold line.

In order that the user, on tearing the sachet can create a sufficiently large pouring spout 90, the notch 80 is preferably at a distance of at least about 4 mm from the second sachet longitudinal edge, the distance being measured perpendicularly to said edge.

The sleeve of the three seal sachet according to FIGS. 10, 11 and 12 may be made with the same process as the sleeve according to FIGS. 1, 2 and 3. Such a process may comprise these steps: a wrapper sheet is pulled over a shaping device whereby the sheet is longitudinally bent to form a sleeve and then two adjoining longitudinal sheet edges are bonded to one another with a longitudinal seal 5. Thereafter, the tubular member formed in such a manner is advanced and is, at predetermined locations, pinched together and is further provided with a transverse seal and with a tear-open slit. Then the leading sachet is severed by a cutting device in such a manner that the trailing sachet opening is guided underneath a product dispensing device which charges the sachet with the product whereupon the open side through which the filling has taken place is closed with a second transverse seal. It is further feasible to provide later a second tear-open slit in the second transverse seal.

It is an advantage of the three seal sachet according to the invention that the tear-open slit applied according to the invention avoids the use of additional materials and ensures a user friendly tear-open aid for sachets having longitudinal and transverse seals having a plurality of bonded layers. "User friendly" in this connection means that even wrapper sheets which can be torn manually only with difficulty such as those made of polyester, polypropylene or oriented polypropylene, may be readily torn with the application of only a slight manual force and further, the obtained open cross section is large. When the tear-open slit according to the invention is used, the sachet may be torn open over 50% of its width. This is of particular importance in relatively narrow elongated sachets which have a length-to-width ratio of, for example, 5:1 or even in normal sachets which contain only poorly pourable material such as powdered soup.

The medicinal product for which the sachet herein is intended is preferably a liquid. The medicinal product will generally include an active agent that falls into at least one of the following pharmacological classifications: antitussives; antihistamines; non-sedating antihistamines; decongestants; expectorants; mucolytics, analgesic, antipyretic antiinflammatory agents, local anesthetics and mixtures thereof. The invention herein, especially in its second aspect, is particularly useful when the active agent is a bitter tasting one and the product further comprises at least about 0.5%, more preferably at least about 0.8% by weight of flavouring agents. The term 'flavouring agent' as used herein means a volatile material having a molecular weight of at least 65 added to improve the taste of the medicinal product. Suitable flavouring agents include anise, oil of peppermint, oil of clove, eucalyptus, lemon, lime, honey lemon, red fruit, grapefruit, orange and, cherry oils and essences as well as cooling agents and warming agents such as carboxamides, menthols, thymol, camphor, capsicum, phenol, eucalyptus oil, benzyl alcohol, salicyl alcohol, ethanol, clove bud oil, and hexylresorcinol, ketals, diols, and mixtures thereof. In preferred embodiments the medicinal product is a treatment for coughs or colds comprising an active agent selected from dextromethorphan, guaiaphenesin, and pseudoephedrine, more preferably the active agent is dextromethorphan, especially in its free base form. Exemplary medicinal products, are disclosed in PCT applications WO 00/41692 and WO 00/41694, both incorporated herein by reference in their entirety.

The materials used to construct the laminate sheet can be any that are customary in the art, such as polyester, polypropylene, polyethylene and polyethylene terephthalate (PET), provided that the sachet is sufficiently tear resistant until correctly manipulated. In preferred embodiments the laminate comprises a layer of aluminium foil. In highly preferred embodiments the laminate comprises a layer of acrylonitrile methyl acrylate copolymer resin on the first laminate sheet face, which will form the inside of the sachet once constructed. This is the layer that will be bonded to itself at the seals. Although acrylonitrile methyl acrylate copolymer resin is more difficult to bond than more commonly used materials it is preferred for its improved flavour barrier properties. Acrylonitrile methyl acrylate copolymer resin is commercially available from BP Chemicals as Barex®. Preferably the laminate comprises a layer of a third material on the second laminate sheet face. In the embodiment shown the laminate comprises a first sheet face of Barex® grade 210 and a second sheet face of PET, sandwiching a layer of aluminium foil. The Barex®, PET and aluminium layers have approximate thicknesses of 12.5, 23 and 8.8 μm respectively.

Since the invention disclosed herein may be embodied in other specific forms without departing from the general characteristics, the embodiment described herein is, therefore, to be considered in all respects as merely illustrative, the scope of the invention being indicated by the appended claims, rather than by the foregoing description; and all embodiments which come within the meaning and range of equivalency of the claims are therefore intended to be embraced therein.

What is claimed is:

1. A three seal sachet for a medicinal product comprising:

a) a laminate sheet comprising opposed first and second longitudinal sheet edges and opposed first and second sheet faces; wherein i) the laminate sheet is folded to form a first sachet edge and opposed first and second sachet faces; and ii) the laminate sheet is sealed to itself along marginal portions of the first and second longitudinal sheet edges on the first sheet face, thereby forming a flattened tube, b) first and second transverse seals bonding together the laminate sheet along marginal portions of first and second transverse edges of the sheet on the first sheet face, thereby closing the tube at each end;

c) a fold line having a length of at least about 8 mm extending from the first transverse edge of the sheet, through the first transverse seal, to a sachet longitudinal edge; and d) a notch passing through the first transverse seal and intersecting the fold line, wherein said notch is at a distance of at least about 4 mm from each end of the fold line and at a distance of at least about 4 mm from the second longitudinal sachet edge, the distance measured perpendicularly to the second longitudinal sachet edge, such that when the sachet is folded along the fold line a cut edge is revealed for tearing open the sachet;

wherein the laminate comprises a layer of acrylonitrile methyl acrylate copolymer resin on the first laminate sheet face and wherein the sachet is both child-resistant and user-friendly to open.

2. A three seal sachet according to claim 1 wherein the laminate comprises a layer of aluminium foil.

3. A three seal sachet according to claim 2 wherein the sachet contains a liquid medicinal product comprising a bitter tasting active agent selected from the group consisting of antitussives, antihistamines, non-sedating antihistamines, decongestants, expectorants, mucolytics, analgesics, antipyretics, anti-inflammatory agents, local anesthetics and mixtures thereof; and at least about 0.5% flavouring agents.

4. A three seal sachet according to claim 3 wherein the liquid medicinal product comprises an active agent selected from the group consisting of dextromethorphan, guaiphenesin, pseudoephedrine and mixtures thereof.

5. A three seal sachet according to claim 1, wherein the first transverse seal has an enlarged area extending longitudinally along the first sachet edge.

6. A three seal sachet according to claim 5, wherein said fold line extends into said enlarged area.

7. A three seal sachet according to claim 1, wherein said notch extends perpendicularly to said fold line.

8. A three seal sachet according to claim 1, wherein the sachet comprises mechanical means to assist folding along the fold line.

9. A three seal sachet according to claim 8, wherein the mechanical means is a crease or an unsealed area extending along the fold line.

* * * * *